US005752450A

United States Patent [19]

Roesner

[11] Patent Number: 5,752,450

[45] Date of Patent: May 19, 1998

[54] MODULAR CONCRETE PICNIC TABLE

[76] Inventor: Dean G. Roesner, 494 Woodcliff Dr., Redding, Calif. 96003

[21] Appl. No.: 751,177

[22] Filed: Nov. 15, 1996

[51] Int. Cl.[6] ..... A47B 13/00

[52] U.S. Cl. ..... 108/161; 297/157.1

[58] Field of Search ..... 297/157.1, 158.3, 297/158.5; 108/161

[56] References Cited

U.S. PATENT DOCUMENTS

| | | | |
|---|---|---|---|
| D. 184,837 | 4/1959 | Sutfin | 297/157.1 X |
| 786,443 | 4/1905 | Johnson | 297/157.1 X |
| 4,330,151 | 5/1982 | Healey | 297/158.3 |
| 4,522,443 | 6/1985 | Van Blakenburg | 297/158.3 |
| 4,607,880 | 8/1986 | Gastebled | 297/158.5 |
| 5,251,955 | 10/1993 | Sarafa | 297/158.5 |
| 5,330,247 | 7/1994 | Fricke | 297/158.3 |

FOREIGN PATENT DOCUMENTS

| | | | |
|---|---|---|---|
| 2467001 | 5/1981 | France | 108/161 |

*Primary Examiner*—Jose V. Chen

[57] ABSTRACT

The disclosure relates to a modular, portable, pre-cast concrete picnic table which can be easily assembled and disassembled into eleven sections without the use of tools. The pre-cast sections are vertically and horizontally assembled and they are secured by use of unattached connecting dowels inserted into opposing vertical or horizontal sockets which are cast within the concrete sections.

1 Claim, 3 Drawing Sheets

Figure 1.A
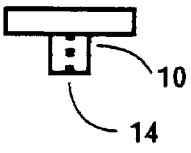
Figure 1.B
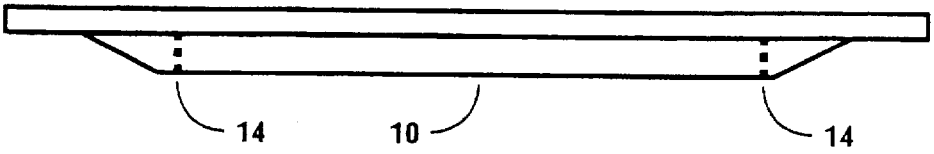
Figure 2.A
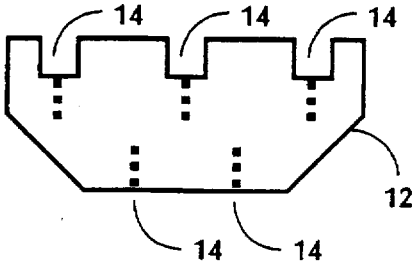
Figure 2.B
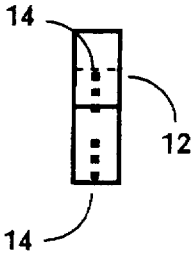
Figure 3.A
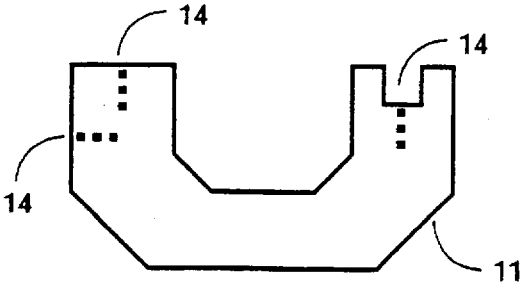
Figure 3.B
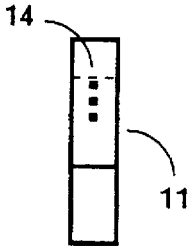

MODULAR CONCRETE PICNIC TABLE

BACKGROUND OF THE INVENTION

1. Field of the Invention

The invention relates to a picnic table or similar structure of outdoor, weather-resistant type and in particular to a durable, portable, modular, pre-cast concrete picnic table which can be easily assembled and disassembled into small enough sections to be easily carried, placed, and installed by two or less people.

2. Description of the Prior Art

There is a problem in the prior art in obtaining pre-cast concrete picnic tables or similar structures which are durable, weather resistant, attractive, easy to assemble, and at the same time able to be person portable.

Prior United States patents relate to various types of prefabricated picnic tables, all of which suffer from at least one of the following disadvantages: Being difficult to assemble, or light-weight fragile structures, or heavy, massive structures subject to machine only transport, or components subject to rapid weather deterioration or, when once assembled and placed, are difficult to disassemble and reposition.

U.S. Pat. No. D243,043 issued to Rogers (1977) is an example of a prior art picnic table which, due to its one piece design, has poor portability compared to the present table and has certainly no person portable attributes at all, as well as no option of individual damaged component replacement capabilities.

U.S. Pat. No. 4,522,443 issued to Blankenburg (1985) is a typical prior art of a durable material/wood hybrid picnic table which, besides being subject to rapid weathering of components and requiring periodic maintenance, also uses numerous mechanical connectors and fasteners, thereby requiring extensive time outlays for both assembly and disassembly.

U.S. Pat. No. 5,367,964 issued to Hockensmith (1994) is an example of a prior art knockdown table using plane surface materials for all primary and support components. It has the disadvantage of being only practical if made from weather susceptible, and maintenance intensive plywood, since the other readily available materials, such as steel, aluminum, or plastic, suffer from one or more of the following limitations: Strength in thin section, or temperature-extreme strength retention, or corrosion resistance, or high material cost and/or machining expense. Plywood is not generally considered a year round weather-resistant and maintenance cost-effective, direct-outdoor exposed material, especially with edge-ply, direct vertical exposure.

OBJECTS AND ADVANTAGES

Compared to the prior art, the present table is a unique combination of stability, durability, portability, maintainability and cost effectiveness of materials, as well as being exceptionally simple to assemble and disassemble. Using only sixteen dowels, the eleven pre-cast sections can be easily and quickly assembled and disassembled. These pre-cast sections include five interchangeable bench/table sections, two interchangeable top support sections, and four interchangeable bottom support sections. These pre-cast sections are easily assembled by simply sliding the dowels into opposing sockets and stacking first the support sections together and them stacking the bench/table sections vertically onto the assembled supports. Vertical loading is carried from the pre-cast seat and table top sections through the support sections to floor. Horizontal loading is resisted by the mass and bearing width of the supports and by the connecting dowels within their sockets.

When assembled, the separate sections form a stable, rigid table that, since none of the dowels and sockets are exposed, does not give the appearance it can be easily disassembled, which is one of its unique features.

The modular, eleven piece construction lends itself to easy transportability, even to the point that all parts can be easily carried by two or less persons, another of its unique features, especially for a concrete picnic table.

It is an object of the present invention to provide a pre-cast concrete picnic table which is attractive, durable, portable, and securely constructed.

It is another object of the present invention to provide a pre-cast concrete picnic table which can be easily assembled and disassembled, and requires no tools for either procedure.

It is another object of the present invention to provide a pre-cast concrete picnic table made of sections that are simply designed and redundant in type (there are only three different shapes comprising the eleven sections) so that a minimum of inventory would have to be carried in order to replace any parts damaged due to vandalism or misuse.

A further object of the invention is to allow easy replacement of damaged parts through ease of assembly and disassembly and commonality of parts as well as the feature of person portability of all parts.

The above objects are met with the present modular, concrete, picnic table.

BRIEF DESCRIPTION OF THE DRAWINGS

FIG. 1.A is an end view of the table/bench sections.

FIG. 1.B is a side view of the table/bench sections.

FIG. 2.A is aside view of the top support sections.

FIG. 2.B is an end view of the top support sections.

FIG. 3.A is an end view of the bottom support sections.

FIG. 3.B is an end view of the bottom support sections.

PICNIC TABLE PARTS LIST

10 table/bench section
11 bottom support section
12 top support section
13 dowel
14 socket

DETAILED DESCRIPTION OF THE INVENTION AND ASSEMBLY

Figure 4:
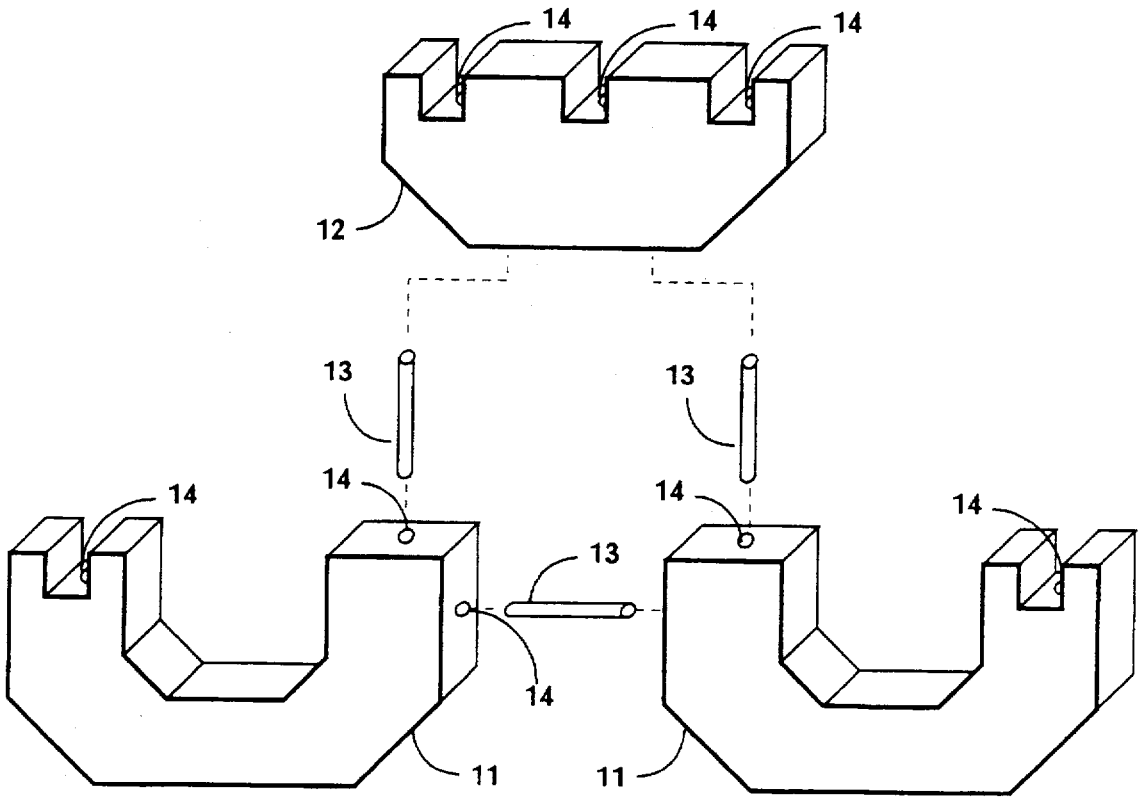
FIG. 4 is a perspective exploded view of the table supports.
Figure 5:
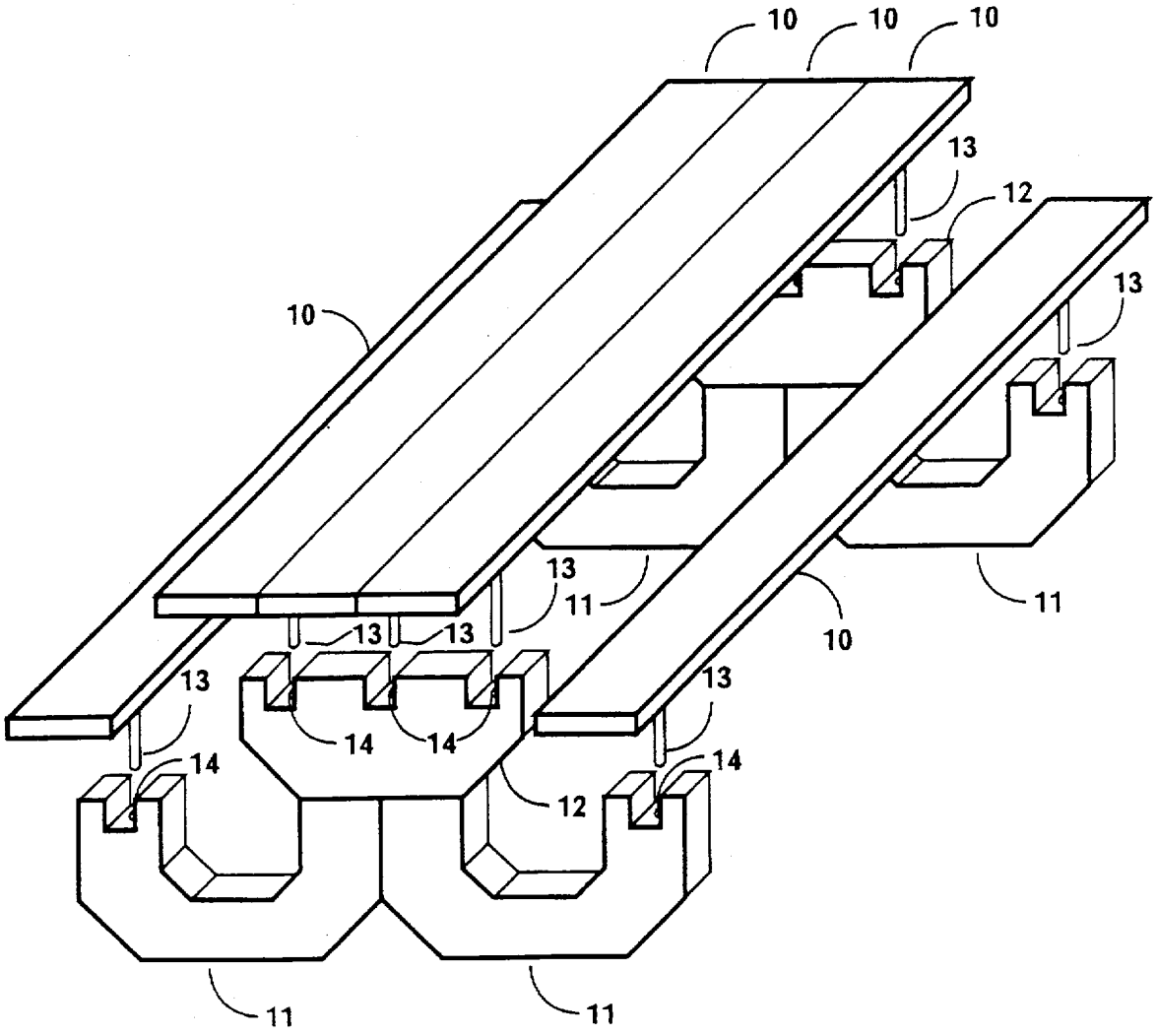
FIG. 5 is a perspective exploded view of all of the sections of the picnic table.

The table consists of four U-shaped identical bottom support sections 11 illustrated as FIGS. 3.A and 3.B joined as two pair to comprise the bottom supports by using a connecting dowel 13 inserted into opposing aligned sockets 14 for each pair. On top of each bottom support pair is joined a top support 12 as in FIGS. 2.A and 2.B using two connecting dowels 13 per support inserted into the opposing aligned sockets 14 to form two completed supports as in FIG. 4. The two completed supports are positioned parallel and the proper distance apart as in FIG. 5 to accept five table/bench sections 10 and are joined to them using ten connecting dowels 13 inserted into the opposing aligned sockets 14 to form a completed table as in FIG. 5.

SUMMARY, RAMIFICATIONS, AND SCOPE

Thus the reader can see that a picnic table can be both durable and person-portable when made of concrete and constructed of a modular design. In addition, by assembling without tools, even the most unskilled and ill equipped person can put together the tables.

Although the description and drawings contain several specifics of design, these should not be construed to limit the scope and design of the invention. For example, the T-shaped table/bench section, designed as such for maximum strength per weight of material, could just as well be rectangular or even L-shaped (inverted) to suit a different criteria or particular need, and the same is true of the shape of the support sections. Also, assuming a suitably strong, light-weight concrete could be developed, the entire picnic table could be made even lighter and thus more person-portable. To heighten aesthetics, wood-grain could be cast into the table sections as well as colors to simulate real wood. Furthermore, by a small design change of the bottom support sections, the picnic table could become simply a table with no attached benches but still using the other original modular pre-cast components and method of assembly.

Thus the scope of the invention should be determined by the appended claims and their legal equivalents, rather than by the specific example given.

What is claimed is:

1. A modular pre-cast concrete picnic table which can be rigidly assembled and disassembled into sections comprising two end sections, each end section comprising two identical bottom support sections, each bottom support section comprising a top and two ends, a socket in one end such that there are two pairs of bottom support sections connected end to end, said top of the bottom support section including two sockets, a table top support section including two sockets in its bottom surface and three sockets in its top surface, said two sockets of the table top support section connected to two corresponding sockets of said top of said bottom support section, two bench sections, each bench section including a plurality of sockets in the bottom surface thereof and extending between and connected to said two end sections at one said socket of said bottom support section, a plurality of table tops, each including a plurality of sockets in the bottom surface thereof, said sockets in the bottom surface of the table tops connected to a corresponding socket at the top of said table top support section, each connection includes a securing means which is defined by a dowel inserted into said corresponding sockets.

* * * * *